US008661955B2

(12) United States Patent
Wu

(10) Patent No.: US 8,661,955 B2
(45) Date of Patent: Mar. 4, 2014

(54) MULTI-CUTTER CUTTING DEVICE

(76) Inventor: Hua Chang Wu, New Taipei (TW)

( * ) Notice: Subject to any disclaimer, the term of this patent is extended or adjusted under 35 U.S.C. 154(b) by 364 days.

(21) Appl. No.: 13/241,909

(22) Filed: Sep. 23, 2011

(65) Prior Publication Data

US 2013/0019734 A1 Jan. 24, 2013

(30) Foreign Application Priority Data

Jul. 21, 2011 (TW) ..... 100213437 A

(51) Int. Cl.
*B26D 1/06* (2006.01)

(52) U.S. Cl.
USPC ..... 83/455; 83/614; 83/485

(58) Field of Classification Search
USPC ..... 83/613, 614, 485, 487, 488, 489, 955, 83/954, 549, 455; 30/306
See application file for complete search history.

(56) References Cited

U.S. PATENT DOCUMENTS 3,648,557 A * 3/1972 Lind ..... 83/489
4,046,044 A * 9/1977 Paterson et al. ..... 83/489
6,990,884 B2 * 1/2006 Tseng ..... 83/618
7,357,057 B2 * 4/2008 Chiang ..... 83/614
8,006,597 B2 * 8/2011 Chiang ..... 83/485
8,485,080 B2 * 7/2013 Loibl ..... 83/614
2005/0028663 A1 * 2/2005 Volfson ..... 83/651
2006/0266191 A1 * 11/2006 Shih ..... 83/614

FOREIGN PATENT DOCUMENTS

TW I250094 3/2006

* cited by examiner

*Primary Examiner* — Kenneth E. Peterson
*Assistant Examiner* — Jennifer Swinney
(74) *Attorney, Agent, or Firm* — Muncy, Geissler, Olds & Lowe, P.C.

(57) ABSTRACT

A multi-cutter cutting device is composed of a chassis having a guide channel, a rotary member rotatably mounted to the chassis and located at one end of the guide channel, and a plurality of cutting units. Each of the cutting units includes a shell mounted to the rotary member, and a cutter rotatably mounted to the shell and having a cutting edge protruding downward from a bottom side of the shell. Each of the cutting units can be moved along with the rotary member and along a radial direction of the rotary member to be separated from the rotary member and then can continue to move along the guide channel. In light of the above, the cutting device is structurally simple and can be easily manufactured and assembled. Besides, the cutting device is flatter to be easily packaged and stored.

12 Claims, 7 Drawing Sheets

MULTI-CUTTER CUTTING DEVICE

BACKGROUND OF THE INVENTION

1. Field of the Invention

The present invention relates generally to a cutting device for cutting papers, and more particularly, to a cutting device having multiple cutters.

2. Description of the Related Art

Taiwan Patent No. I250094 disclosed an upright rolling-type multi-function cutting device, which is composed of a chassis provided for placing papers thereon, a carrier capable of slidable movement along a guide rail formed on the chassis, an adaptor mounted to the carrier for rotation on a horizontal central axis, and a plurality of cutters mounted to an external edge of the adaptor for rotation on a horizontal central axis. A user can turn the adaptor to drive one of the cutters to move to the lowermost side and then move the carrier to drive the cutter to rollingly cut a paper put on the chassis. The cutters can have blades of various shapes for the user to switch selectively from one to another. Besides, this conventional cutting device can further include a fastener for fastening the adaptor to where the cutter located at the lowermost side can cut the paper.

The aforesaid conventional cutting device is structurally complicated and its production and assembly are rather difficult. Besides, the cutting device has a certain height, so it is inconvenient to package or store it. If one or more cutters are additionally mounted to the cutting device, the adaptor will need larger external diameter and the cutting device will become higher as a whole. Besides, while the cutting device is cutting a paper, all of the elements excluding the chassis and the guide rail are not moved at the same time, so it is less convenient to operate the conventional cutting device.

In other words, the aforesaid conventional cutting device is still deficient to need further improvement.

SUMMARY OF THE INVENTION

The primary objective of the present invention is to provide a multi-cutter cutting device, which is structurally simple and easily manufactured and assembled.

The secondary objective of the present invention is to provide a multi-cutter cutting device, which can be easily packaged and stored to be convenient in operation.

The foregoing objectives of the present invention are attained by the multi-cutter cutting device composed of a chassis, a rotary member, and a plurality of cutting units. The chassis includes a guide channel. The rotary member is rotatably mounted to the chassis and located at one end of the guide channel. Each of the cutting units includes a shell mounted to the rotary member, and a cutter rotatably mounted to the shell and having a cutting edge protruding downward from a bottom side of the shell. Each of the cutting units can be moved along with the rotary member and along a radial direction of the rotary member to be separated from the rotary member and then can continue to move along the guide channel.

The cutting edges of the cutting units can have a variety of shapes for the user to switch therebetween subject to his or her needs. The user can turn the rotary member to drive one selected from the cutting units to move along the guide channel to further drive the cutting unit to cut a to-be-cut object (e.g. paper) placed below the guide channel. The rotary member is set horizontally and the cutter of each cutting unit is set vertically, so the external diameter of the rotary member does not need to be very large and a great number of the cutting units can be mounted to the rotary member; besides, the cutting device can be easily packaged and stored because the whole shape is flatter than the prior art. In addition, while the cutting device is operated to cut a paper, the user only needs to move one of the cutting units, so the present invention is more convenient in operation than the prior art.

DETAILED DESCRIPTION OF PREFERRED EMBODIMENTS

Figure 1:
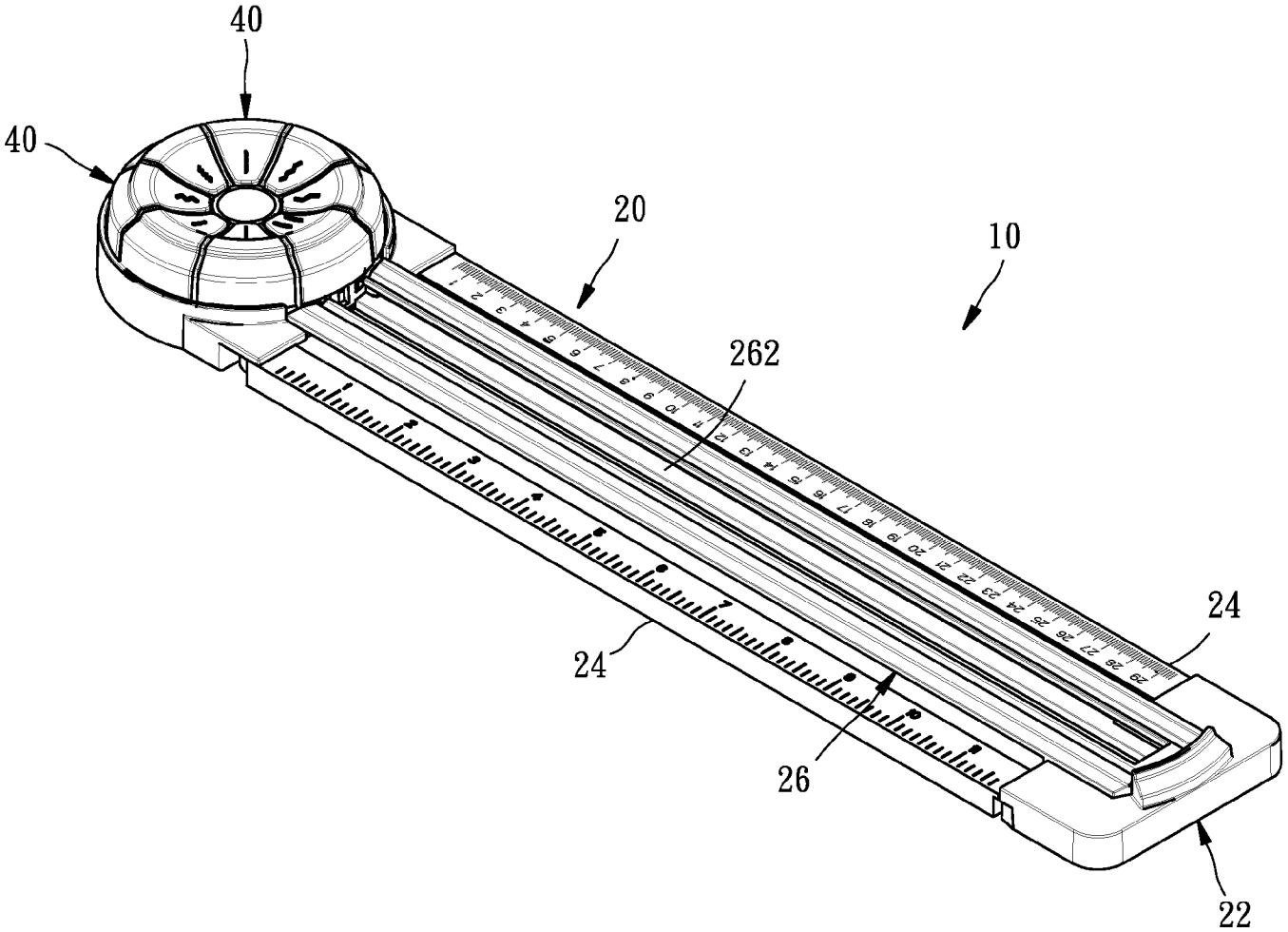
FIG. 1 is a perspective view of a preferred embodiment of the present invention.
Figure 2:
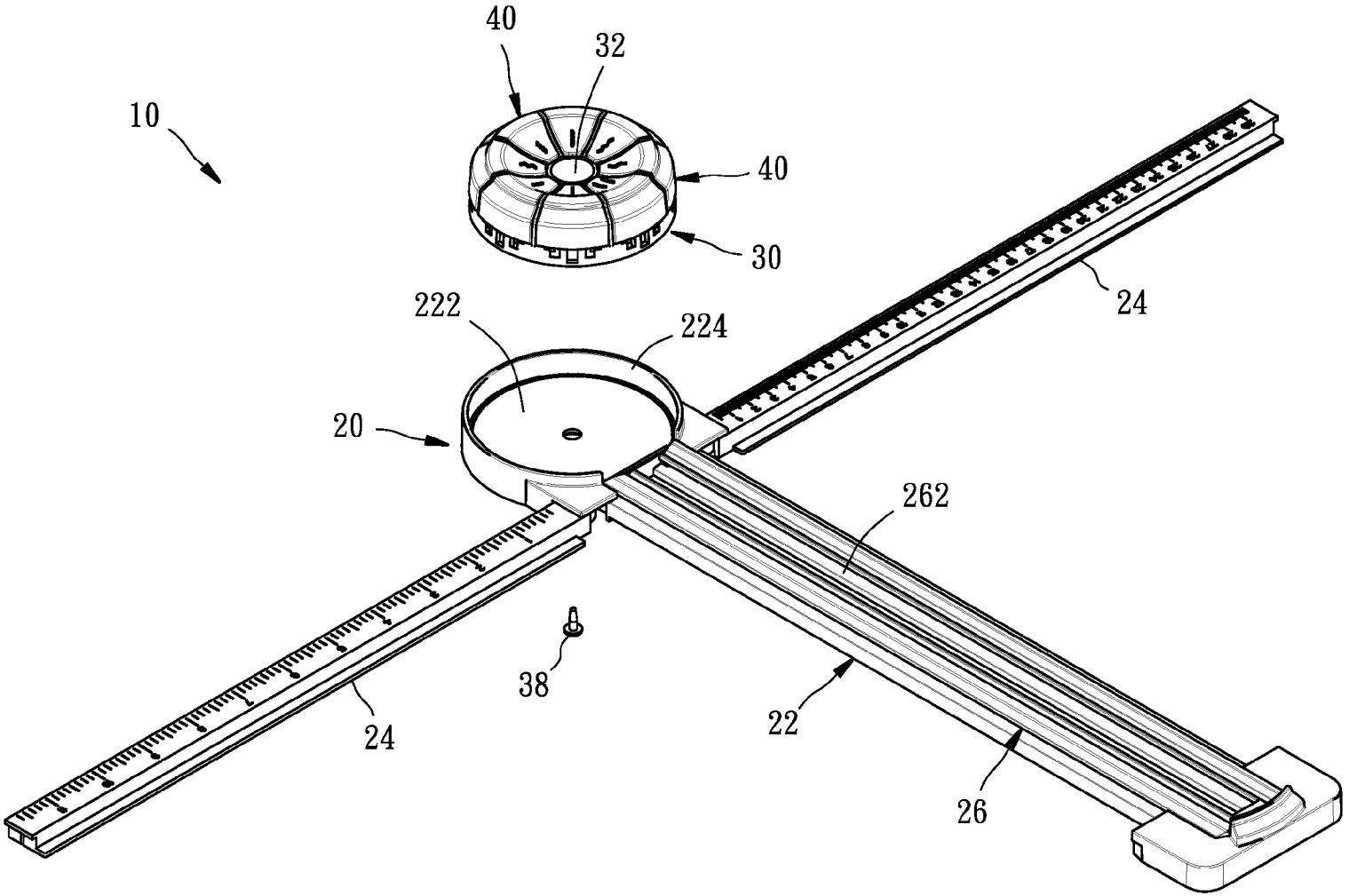
FIG. 2 is a partially exploded view of the preferred embodiment of the present invention.
Figure 3:
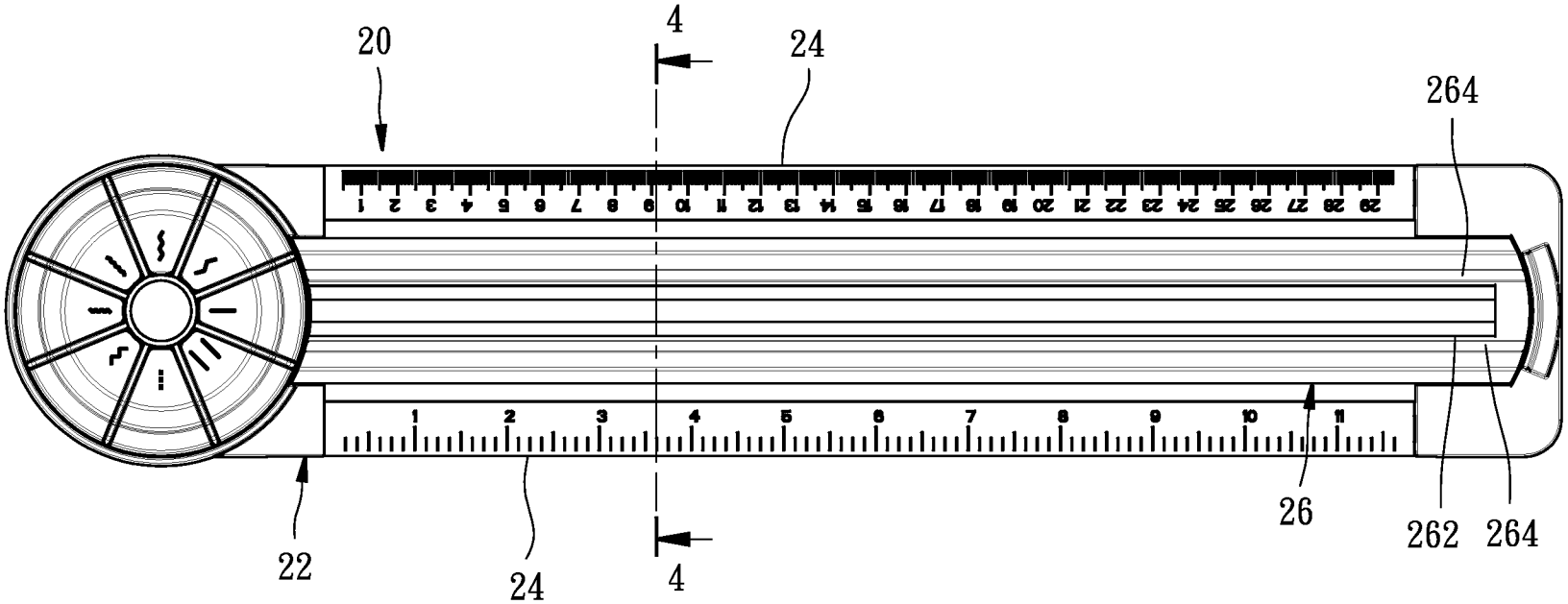
FIG. 3 is a top view of the preferred embodiment of the present invention.

Referring to FIGS. 1-3, a multi-cutter cutting device 10 constructed according to a preferred embodiment of the present invention is composed of a chassis 20, a rotary member 30, and eight cutting units 40. The detailed descriptions and operations of these elements as well as their interrelations are recited in the respective paragraphs as follows.

Figure 4:
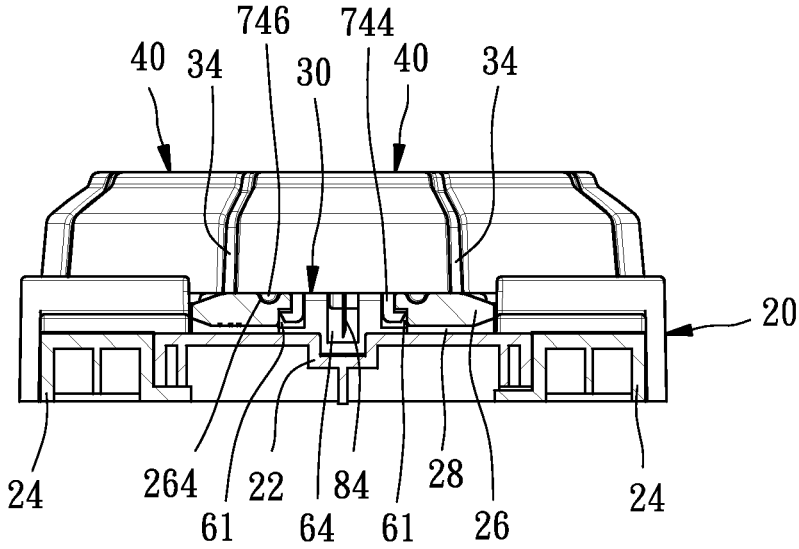
FIG. 4 is a sectional view taken from a line 4-4 indicated in FIG. 3.
Figure 5:
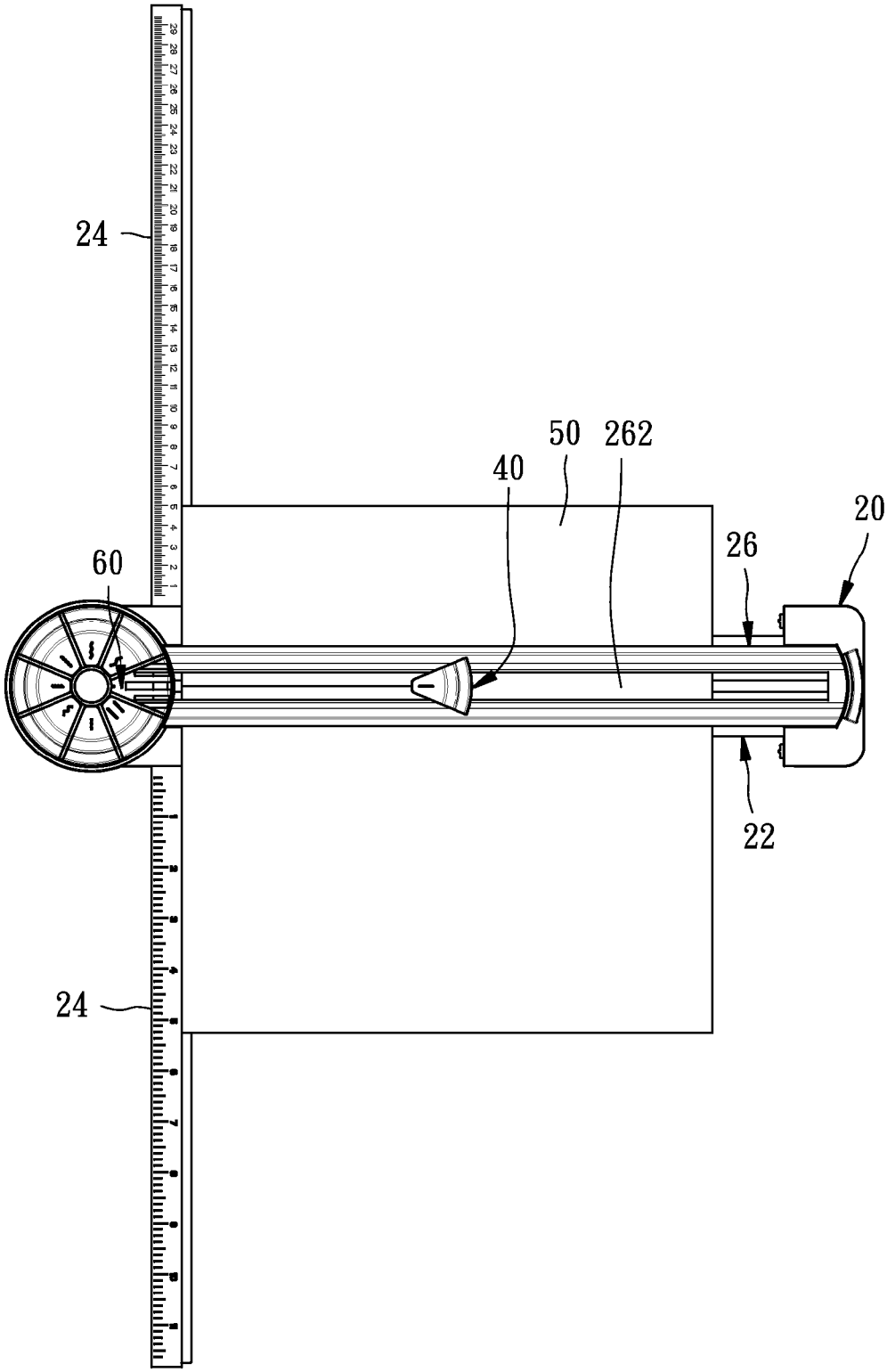
FIG. 5 is a top view of the preferred embodiment of the present invention in operation.

The chassis 20 includes a main body 22, two rulers 24 pivoted to the main body 22, and an oppressor 26 mounted onto the main body 22. The main body 22 has a circular chamber 222 formed at one end thereof. The oppressor 26 has two ends engaged with the main body 22, a guide channel 262 running through and communicating with the chamber 222, and two recessions 264 recessed from a top side of the oppressor 26 and parallel to the guide channel 262. A sheety to-be-cut object 50 (e.g. paper) can be inserted into a gap 28 formed between the oppressor 26 and the main body 22, as shown in FIG. 4. The two rulers 24 can be provided for the user to measure where the to-be-cut object 50 should be put, as shown in FIG. 5.

Figure 6:
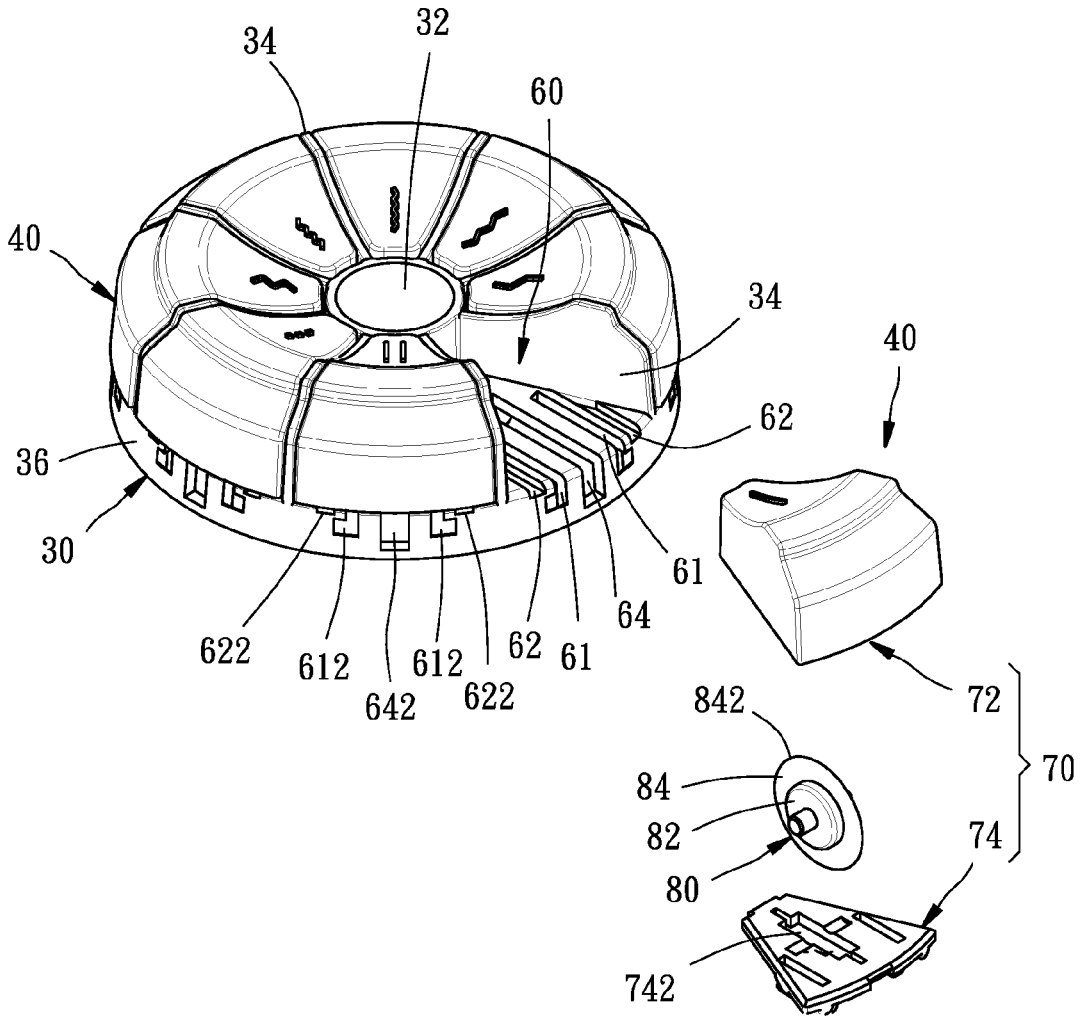
FIG. 6 is an exploded view of a part of the preferred embodiment of the present invention.
Figure 7:
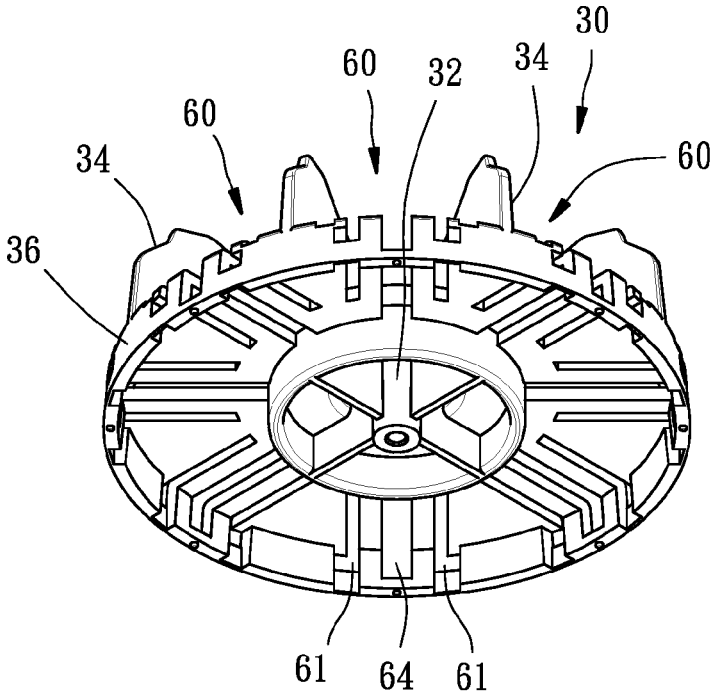
FIG. 7 is a perspective view of a part of the preferred embodiment of the present invention.

Referring to FIGS. 6 and 7, the rotary member 30 includes a central portion 32, eight spacers 34 radially connected with the central portion 32, and eight receiving portions 60 radially extending outward from the central portion 32. Each of the receiving portions 60 has two first slide grooves 61, two second slide grooves 62, each of which is located between one of the two first slide grooves 61 and one of the spacers 34, and a ditch 64 located between the two first slide grooves 61. The first and second slide grooves 61 and 62 and the ditch 64 include openings 612, 622, and 642 formed on an external peripheral surface 36 of the rotary member 30 separately.

Figure 8:
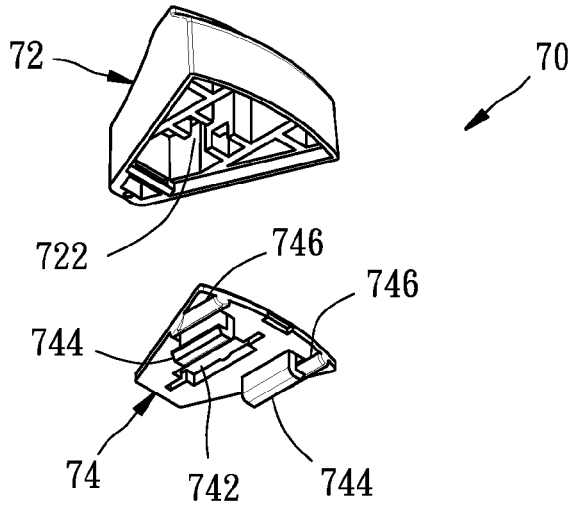
FIG. 8 is an exploded view of a part of the preferred embodiment of the present invention.

Referring to FIG. 6 again, each of the cutting units 40 includes a shell 70 and a cutter 80. Each of the shells 70 has a top member 72 and a bottom member 74. Each of the cutters 80 has a rotary shaft 82 and a blade 84 fixedly connected with the rotary shaft 82. Each of the blades 84 has a cutting edge 842 surrounding the rotary shaft 82. As shown in FIG. 8, the top member 72 has a cutter space 722 having an opening facing downward. The bottom member 74 has a through hole 742 corresponding to the cutter space 722. Each of the rotary shafts 82 is confined inside the cutter space 722 by the bottom member 74. Each of the cutting edges 842 has a part protruding downward out of the through hole 742. Each of the cutters 80 is rotatable with respect to the shell 70. The bottom member 74 has two hooked first guide pieces 744 and a semicircular second guide piece 746. Each of the first guide pieces 744 protrudes outward from a bottom side of the bottom member 74.

The cutting units 40 are mounted to the receiving portions 60 separately. In each of the shells 70, the first and second guide pieces 744 and 746 are slidably mounted to the first and second slide grooves 61 and 62 of each receiving portion 60. Each of the cutting edges 842 is suspended inside one of the ditches 64. The cutting units 40 and the rotary member 30 are constituted to become a pie-like structure. The rotary member 30 is pivotably connected to the chamber 222 by a bolt 38 (FIG. 2) connected with a bottom end of the central portion 32. In this way, the rotary member 30 is located at one end of the guide channel 262 and can allow the user to turn itself to move one of the cutting units 40 along the guide channel 262 to enable the first slide groove 61 and the ditch 64 to communicate with the guide channel 262. The openings 612, 622, and 642 of the slide grooves 61, 62 and 64, which do not communicate with the guide channel 262, are covered by a sidewall 224 of the chamber 222. In the meantime, only the cutting unit 40 located at one end of the guide channel 262 can be pushed by the user to move along a radial direction of the rotary member 30 to be separated from the rotary member 30 and then move along the guide channel 262, as shown in FIG. 5.

When the cutting unit 40 is moved along the guide channel 262, the first guide piece 744 can slide along two sides of the guide channel 262 and the two second guide pieces 746 can slide along the recessions 264 separately, so the cutting unit 40 can keep linearly moving very stably to enable the cutting edge 842 to roll over the to-be-cut object 50 linearly to further cut a straight incision corresponding to the cutting edge 842 on the to-be-cut object 50. The cutting edges 842 of the cutters 80 can have a variety of shapes and each of the shells 70 can be labeled thereon with the shape of the cutting edge 842 in such a way that the user can turns the rotary member 30 to switch from one to another for cutting operation subject to the required circumstance.

The cutting device 10 of the present invention is structurally simpler than the prior art, so it can be manufactured and assembled more easily. Besides, the cutting device 10 is flat on the whole, so it is more convenient to package and store the cutting device 10 than the prior art. Further, the rotary member 30 does not need to have a very large diameter for mounting lots of the cutting units 40 thereto. Even if more cutting units 40 need to be mounted to the cutting device 10, the cutting device 10 will not become bigger on the whole and its height will remain unchanged. At last, while the cutting device 10 is operated, the user only needs to move one of the cutting units 40 to do his or her job, so it is very convenient in operation.

Although the present invention has been described with respect to a specific preferred embodiment thereof, it is in no way limited to the specifics of the illustrated structures but changes and modifications may be made within the scope of the appended claims.

What is claimed is:

1. A multi-cutter cutting device comprising: a base;

a chassis having a guide channel, disposed above the base;

a rotary member rotatably mounted to the chassis about an axis extending perpendicular to the guide channel, and located at one end of the guide channel; and a plurality of cutting units having a shell and a cutter, each of the shells being mounted to the rotary member, each of the cutters being rotatably mounted to one of the shells, each of the cutters having a cutting edge protruding downward out of a bottom 10 side of the shell; one of the cutting units can be moved along with rotation of the rotary member and along a radial direction of the rotary member to be separated from the rotary member and then can continue to move along the guide channel, with the respective shell slidably mating with the guide channel and the cutting edge engaging the base.

2. The multi-cutter cutting device as defined in claim 1, wherein the rotary member comprises a central portion pivoted to the chassis and a plurality of receiving portions extending outward radially from the central portion; the cutting units are mounted to the receiving portions respectively, each of the receiving portions being movable along with rotation of the rotary member for communication with the guide channel.

3. The multi-cutter cutting device as defined in claim 2, wherein each of the shells comprises a first guide piece protruding from a bottom side thereof and is slidable along the guide channel; each of the receiving portions comprises a first slide groove for the first guide piece to be slidably mounted thereto and a ditch for the cutting edge to be suspended therein, each of the first slide grooves and the ditches having an opening located at an external peripheral surface of the rotary member.

4. The multi-cutter cutting device as defined in claim 3, wherein the rotary member is mounted to a chamber of the chassis in communication with the guide channel, the chamber having a sidewall covering openings of the first slide groove and the ditch of the receiving portion, which is not in communication with the guide channel.

5. The multi-cutter cutting device as defined in claim 4, wherein the chassis comprises a main body and an oppressor mounted onto the main body; the guide channel runs through the oppressor and further comprises a recession parallel to the guide channel; each of the shells further comprises a second guide piece protruding from a bottom side thereof and being slidable along the recession; each of the receiving portions further comprises a second slide groove for the second slide guide piece to be slidably mounted thereto.

6. The multi-cutter cutting device as defined in claim 5, wherein each of the shells comprises a top member and a bottom member, the top member having a cutter space having an opening facing downward, the bottom member being mounted to a bottom side of the top member and having a through hole corresponding to the cutter space; the first and second guide pieces are located at the bottom member; each of the cutters comprises a rotary shaft confined inside the cutter space by the bottom member; the cutting edge surrounds the rotary shaft and protrudes out of the through hole.

7. The multi-cutter cutting device as defined in claim 4, wherein each of the shells comprises a top member and a bottom member, the top member having a cutter space having an opening facing downward, the bottom member being engaged with a bottom side of the top member and having a through hole corresponding to the cutter space; each of the cutters comprises a rotary shaft confined inside the cutter space by the bottom member; the cutting edge surrounds the rotary shaft and protrudes out of the through hole.

8. The multi-cutter cutting device as defined in claim 3, wherein the chassis comprises a main body and an oppressor mounted onto the main body; the guide channel runs through the oppressor and further comprises a recession parallel to the guide channel; each of the shells further comprises a second guide piece protruding from a bottom side thereof and being slidable along the recession; each of the receiving portions further comprises a second slide groove for the second slide guide piece to be slidably mounted thereto.

9. The multi-cutter cutting device as defined in claim 8, wherein each of the shells comprises a top member and a bottom member, the top member having a cutter space having an opening facing downward, the bottom member being mounted to a bottom side of the top member and having a through hole corresponding to the cutter space; the first and second guide pieces are located at the bottom member; each of the cutters comprises a rotary shaft confined inside the cutter space by the bottom member; the cutting edge surrounds the rotary shaft and protrudes out of the through hole.

10. The multi-cutter cutting device as defined in claim 3, wherein each of the shells comprises a top member and a bottom member, the top member having a cutter space having an opening facing downward, the bottom member being engaged with a bottom side of the top member and having a through hole corresponding to the cutter space; each of the cutters comprises a rotary shaft confined inside the cutter space by the bottom member; the cutting edge surrounds the rotary shaft and protrudes out of the through hole.

11. The multi-cutter cutting device as defined in claim 2, wherein each of the shells comprises a top member and a bottom member, the top member having a cutter space having an opening facing downward, the bottom member being engaged with a bottom side of the top member and having a through hole corresponding to the cutter space; each of the cutters comprises a rotary shaft confined inside the cutter space by the bottom member; the cutting edge surrounds the rotary shaft and protrudes out of the through hole.

12. The multi-cutter cutting device as defined in claim 1, wherein each of the shells comprises a top member and a bottom member, the top member having a cutter space having an opening facing downward, the bottom member being engaged with a bottom side of the top member and having a through hole corresponding to the cutter space; each of the cutters comprises a rotary shaft confined inside the cutter space by the bottom member; the cutting edge surrounds the rotary shaft and protrudes out of the through hole.

* * * * *